US008240067B2

(12) United States Patent
Sussmann

(10) Patent No.: US 8,240,067 B2
(45) Date of Patent: Aug. 14, 2012

(54) SHOE, IN PARTICULAR SPORTS SHOE

(75) Inventor: Reinhold Sussmann, Scheinfeld (DE)

(73) Assignee: Puma Aktiengesellschaft Rudolf Dassler Sport, Herzogenaurach (DE)

( * ) Notice: Subject to any disclaimer, the term of this patent is extended or adjusted under 35 U.S.C. 154(b) by 1071 days.

(21) Appl. No.: 12/160,256

(22) PCT Filed: Jan. 2, 2007

(86) PCT No.: PCT/EP2007/000001
§ 371 (c)(1),
(2), (4) Date: Jul. 8, 2008

(87) PCT Pub. No.: WO2007/080062
PCT Pub. Date: Jul. 19, 2007

(65) Prior Publication Data

US 2009/0019732 A1 Jan. 22, 2009

(30) Foreign Application Priority Data

Jan. 9, 2006 (DE) ..... 20 2006 000 230 U

(51) Int. Cl.
*A43B 13/16* (2006.01)
*A43B 23/00* (2006.01)

(52) U.S. Cl. ..... 36/103; 36/31; 36/107

(58) Field of Classification Search ..... 36/15, 31, 36/103, 107, 108
See application file for complete search history.

(56) References Cited

U.S. PATENT DOCUMENTS 4,542,598 A * 9/1985 Misevich et al. ..... 36/114
5,682,685 A * 11/1997 Terlizzi ..... 36/8.3
6,233,846 B1 5/2001 Sordi
6,895,693 B2 * 5/2005 Baruck ..... 36/8.3
2001/0005947 A1 * 7/2001 Sordi ..... 36/102
2002/0078591 A1 6/2002 Morrone
2002/0092201 A1 7/2002 Kraeuter et al.
2003/0029055 A1 2/2003 Morrone
2003/0121176 A1 7/2003 Baruck
2003/0131501 A1 7/2003 Erickson et al.
2005/0022421 A1 * 2/2005 Bruckner ..... 36/8.3

FOREIGN PATENT DOCUMENTS

DE 203 19 465 3/2004

(Continued)

*Primary Examiner* — Khoa Huynh
*Assistant Examiner* — Sharon M Prange
(74) *Attorney, Agent, or Firm* — Lucas & Mercanti, LLP

(57) ABSTRACT

The invention relates to a shoe, especially to a sports shoe, with a shoe upper (1) and a sole (2, 3) consisting of at least two parts, wherein at least one part of the sole (2) is arranged in the forefoot region and at least on part of the sole (3) is arranged in the rearfoot region, wherein the shoe upper (1) has at least two cutouts (4, 5) in the region facing the ground, wherein the size and the shape of the cutouts (4, 5) correspond to those of the parts of the sole (2, 3) in their contact region with the shoe upper (1), wherein the parts of the sole (2, 3) are inserted into or are placed at the cutouts (4, 5) and are connected with the shoe upper (1) permanently. To obtain a high flexibility of the shoe and having a low weight the invention is characterized in that the shoe upper (1) as well as the parts of the sole (2, 3) consist of a material with a low bending stiffness, wherein a sole element (7) which is adapted to the shape of the foot and which has a high bending stiffness is arranged in the interior of the shoe above the parts of the sole (2, 3).

18 Claims, 5 Drawing Sheets

FOREIGN PATENT DOCUMENTS

Figure 1:
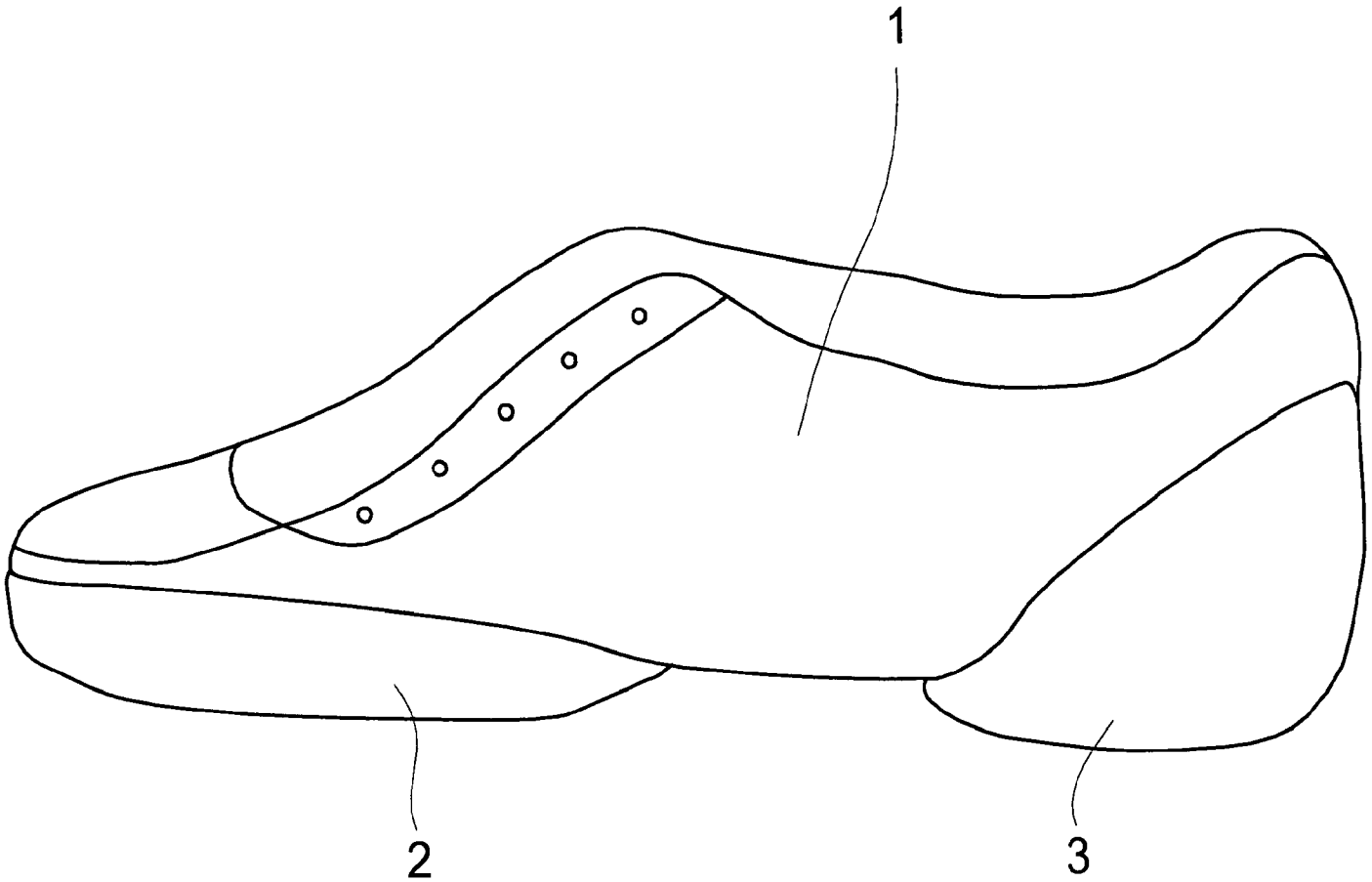

| | | | |
|---|---|---|---|
| EP | 1 114 591 | | 7/2001 |
| EP | 1308103 | A2 | 10/2003 |
| FR | 28 13 765 | | 3/2002 |
| GB | 2 156 652 | Y | 10/1985 |
| GB | 2 245 813 | Y | 1/1992 |
| WO | 2004/103105 | X | 12/2004 |

* cited by examiner

SHOE, IN PARTICULAR SPORTS SHOE

The invention relates to a shoe, especially to a sports shoe, with a shoe upper and a sole consisting of at least two parts, wherein at least one part of the sole is arranged in the forefoot region and at least on part of the sole is arranged in the rearfoot region, wherein the shoe upper has at least two cutouts in the region facing the ground, wherein the size and the shape of the cutouts correspond to those of the parts of the sole in their contact region with the shoe upper, wherein the parts of the sole are inserted into or are placed at the cutouts and are connected with the shoe upper permanently.

Shoes according to this kind often show a sole part in the forefoot and in the rearfoot region which are sewed of glued with the shoe upper to connect the parts permanently. Depending on the purpose of use the shoe must have a certain weight which should be as low as possible and must allow a handling what requires a definite stiffness of the shoe. A solution of this kind is shown in US 2003/0121176 A1.

For some applications it is namely desired to design the shoe very flexible, what is specifically interesting when it ought to be placed in a suitcase for taking it on a travel. In this connection it is important as well that the weight of the shoe is as low as possible.

However, the properties of the shoe during use should not differ in a negative way from that one of shoes of the kind mention above. It is also desirable that the shoe can be specifically adapted to defined desires of the wearer—in terms of the properties of rigidity.

Of course, a further aspect is the costs of manufacturing which should be as low as possible.

It is the object of the invention to further develop a shoe, especially a sports shoe, of the kind mentioned above so that it better meets the mentioned requirements than pre-known shoes. Especially, the shoe should have a very low weight, it should be designed very flexible and it should have a high adaptability to the individual needs of the wearer.

The solution of this object according to the invention is characterized in that the shoe upper as well as the parts of the sole consist of a material with a low bending stiffness, wherein a sole element which is adapted to the shape of the foot and which has a high bending stiffness is arranged in the interior of the shoe above the parts of the sole.

The shoe upper can be designed continuously between the parts of the sole, wherein the shoe upper can be designed especially seamless between the parts of the sole.

According to an embodiment of the invention at least one of the parts of the sole can be designed as a shell-shaped formation. Here, especially a heel shell for the rearfoot region is suggested which is adapted to the shape of the foot correspondingly.

To ensure a good fixation of the parts of the sole at the upper, an embodiment suggests that at least one of the parts of the sole has a web, which overlaps with the shoe upper. Insofar, the parts of the sole are thus designed marginally bigger than the cutouts, what has to be understood however in the meaning of the above specification that the size and the shape of the cutouts correspond to that one of the parts of the sole in the contact region with the shoe upper. The web can be designed circumferentially along the connection region of the parts of the sole with the shoe upper.

The shoe upper can be equipped with a lining in its interior at least partially. But preferably the lining does not extend into the region of the parts of the sole.

To collapse the shoe—consisting of the shoe upper and the parts of the sole—in an easy way, the shoe upper as well as the parts of the sole consist of a material with a low bending stiffness. The shoe upper consists preferably of leather, artificial leather and/or textile material. However, the sole parts can consist of rubber, polyurethane, polyamide, thermoplastic caoutchouc, ethyl vinyl acetate (EVA) or a mixture of these materials To provide the shoe with the necessary stiffness for a usual use, a sole element with a high bending stiffness, which is adapted to the shape of the foot, can be arranged in the interior of the shoe above the parts of the sole. This sole element can extend from the toe region to the heel region continuously.

The bending stiffness, which should be low for the shoe upper and the parts of the sole and which should be high for the sole element, has to be understood in that way, what flexibility and deformability respectively the shoe upper and the parts of the sole at the one hand and the sole element at the other hand have as a result of a bending moment, which is induced into the shoe standing on the ground—horizontally and transversally to the longitudinal direction of the shoe. If a bending moment of the mentioned kind is induced into the shoe upper and the parts of the sole and in the sole element respectively, the bending stiffness of the sole element should be at least three times, preferably fife time, specifically preferred ten times, the bending stiffness of the shoe upper with the parts of the sole. Conversely, the deformation of the shoe upper with the parts of the sole caused by the bending moment of the mentioned kind should be at least three times, fife times and ten times respectively as big as that one of the sole element.

The sole element can consists of a forefoot part and a rearfoot part, wherein the two parts are connected by a hinge or an articulation. The hinge can be designed as a plastic joint which is directly injection molded to the both parts. Furthermore, the hinge can consist of polyurethane, polyamide, polyethylene, polypropylene or a mixture of these materials.

The sole element can be provided with reinforcing fibers, wherein primary glass fibers or carbon fibers are suggested. The stiffness of the sole element is further increased if it has an at least partially enhanced and/or circumferential edge.

The shoe upper and the parts of the sole can be sewn together, glued together and/or welded together.

Furthermore, the parts of the sole can be provided with ventilation slots or with other functional elements, like e.g. an abrasion zone. The abrasion zone can be a coating with a rubber-like material which is applied on the part of the sole and which ensures a good adhesion on the ground. Of course, the parts of the sole itself can be manufactured from a rubber material. Also, it is possible that at least one of the parts of the sole is provided with a damping element.

With the invention proposal miscellaneous advantages are obtained, which—especially when co-operating—lead to a substantial improvement of the handling and the use of the shoe, especially in the case of a sports shoe.

By the direct connection, e.g. by sewing, and the missing material of the shoeleg in the region of the parts of the sole the weight of the shoe is decreased.

Because it is not necessary and stipulated for the shoe according to the invention to provide several layers of material (i.e. a sandwich design) and thus several locations of gluing, a very flexible shoe structure results as long as the stiff insole is not inserted.

Because no or at least fewer locations of gluing are necessary the shoeleg can be manufactured substantially more economical.

Due to the lesser demand for glue the manufacturing is also more ecologically friendly.

By the respective selection of the stiff insole the possibility is given to adapt the shoe to individual desires. Here, the insole can be selected form a plurality of different insoles by which the requirements of the wearer are fulfilled best.

During the manufacturing an optimal match of the shape of the shoe upper to the shape of the last is obtained, because no interlayers or accumulation of material in the bottom region of the shoe can occur.

In the figures an embodiment of the invention is depicted.

Figure 2:
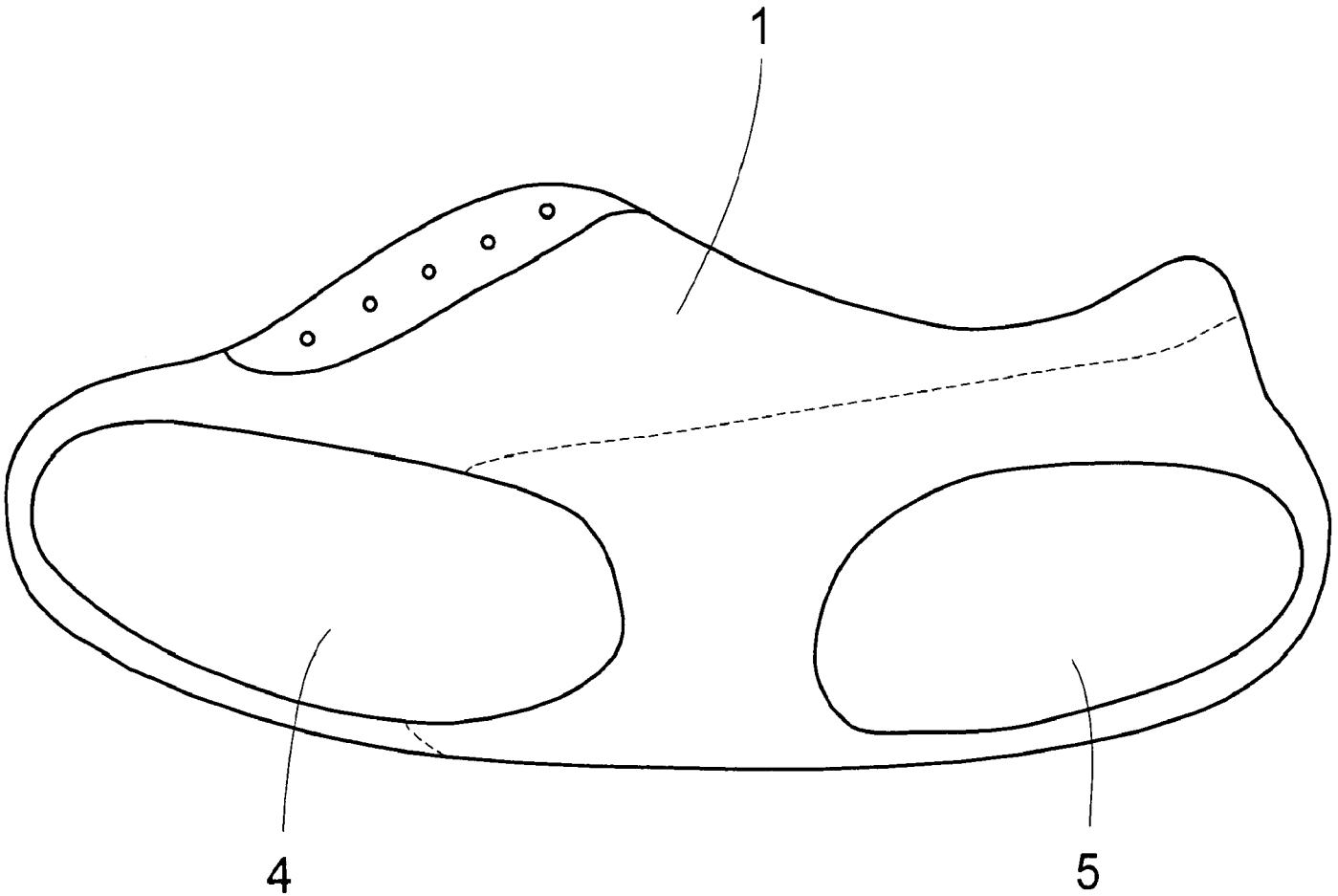
Figure 3:
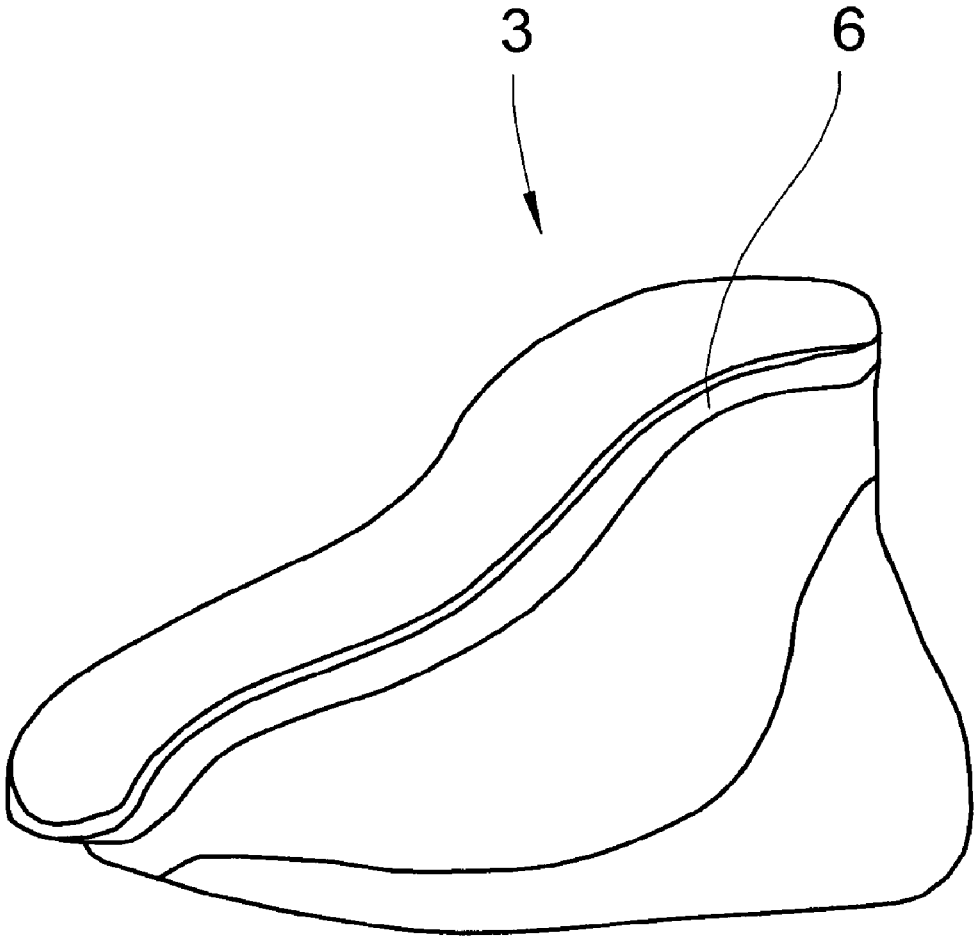
Figure 4:
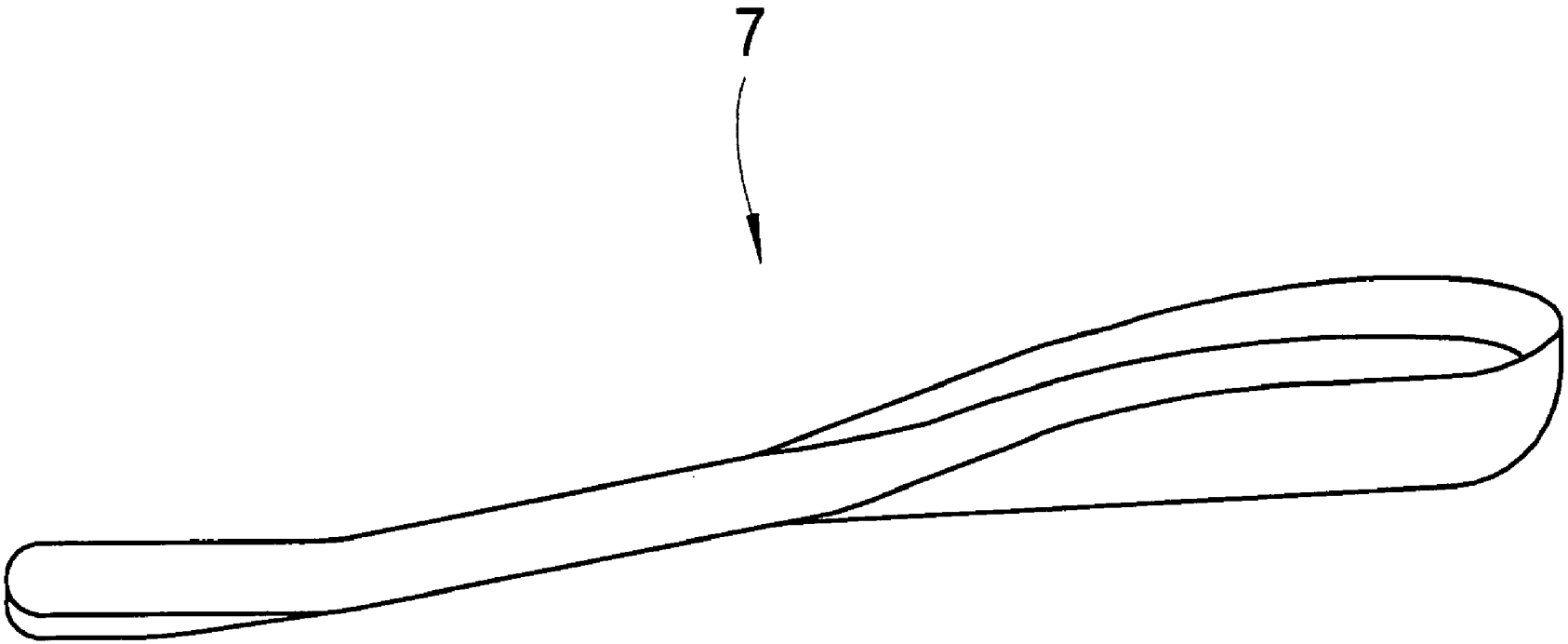
Figure 5A:
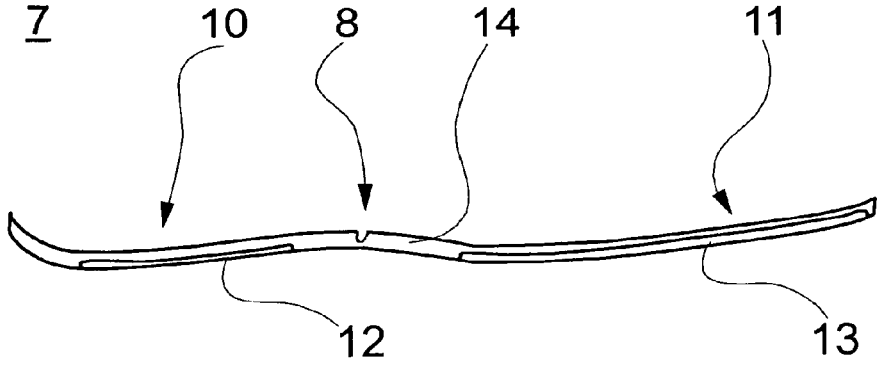
Figure 5B:
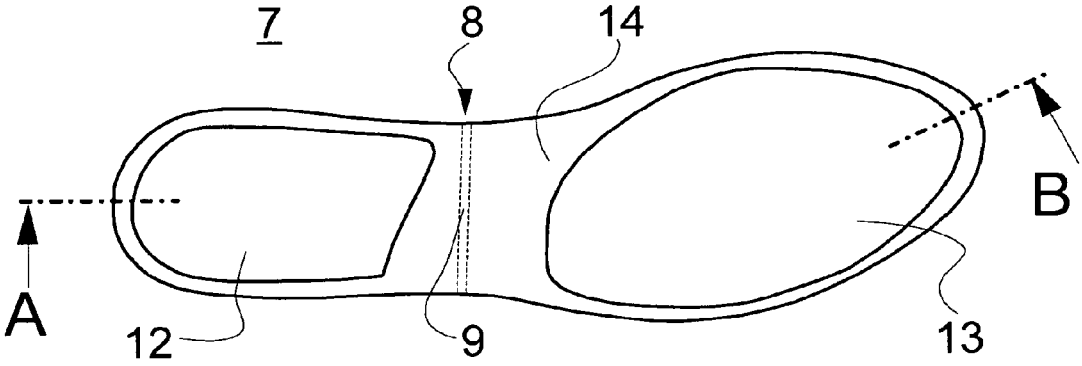
Figure 6:
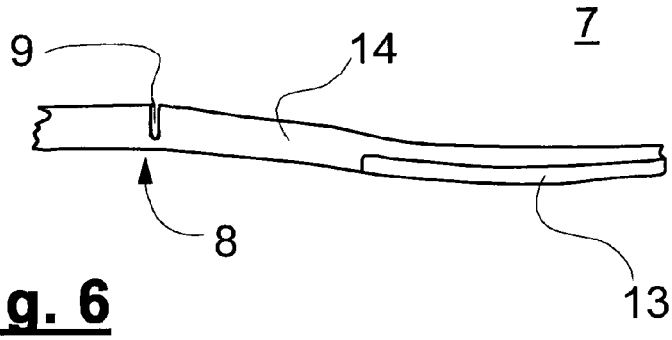

FIG. 1 shoes schematically a sports shoe in perspective view,

FIG. 2 shows the shoe upper without sole elements in a perspective view from below, FIG. 3 shows in perspective view a heel part of the sole, FIG. 4 shows in perspective view a stiff insole for the shoe, FIG. 5*a* shows another embodiment of the insole in the side view in the section A-B according to FIG. 5*b*, FIG. 5*b* shows the insole according FIG. 5*a* from below, FIG. 6 shows an enlarged detail of the middle region of the insole in the depiction according to FIG. 5*a*.

In FIG. 1 a shoe, namely a sports shoe, is shown. The shoe has a shoe upper 1 as usual. It has a two-part sole 2, 3: In the forefoot region of the shoe a sole part 2 is arranged, in the rearfoot part a sole part 3 is arranged.

In FIG. 2 the shoe upper 1 is shown without the part of the sole 2, 3. As can be seen the shoe upper 1 has cutouts 4 and 5 respectively, which correspond to the size and shape of the parts of the sole 2, 3. Thus, according to the invention it is suggested that the shoe upper 1 has at least two cutouts 4, 5 in the region facing the ground, wherein the size and the shape of the cutouts 4, 5 correspond to those of the parts of the sole 2, 3 in their contact region with the shoe upper 1. The parts of the sole 4, 5 are inserted into or are placed at the cutouts 4, 5 and are then connected with the shoe upper 1 permanently.

This connection can be done by sewing, by welding, by gluing or in a similar manner, wherein also a combination of these can be provided.

The part of the sole 3 to be inserted into the cutout 5 is shown in FIG. 3. It can be seen that the part of the sole is designed as a heel part here, which has in the border area a revolving web 6, which is designed for overlapping with the material of the shoe upper 1 in the border area of the cutout 5. The part of the sole 3 is connected with the shoe upper 1—according to the height of the web 6—in this overlapping region.

The part of the sole 2 as well as the part of the sole 3 are manufactured from a soft and bendable material. For this e.g. rubber can used. The shoe, which consists of an upper material with low rigidity, can so be coiled up regularly, for e.g. placing it in a suitcase.

In order to use the sports shoe in a usual manner it must be stiffened before use. For this a sole element 7 in form of an insole is provided which is depicted in FIG. 4 and which consists of a material with a relatively high rigidity. Here, especially a hardener plastic material is suggested which is provided with reinforcing fibers (composite material).

If the sole element 7 is inserted into the interior of the shoe, the shoe obtains its usual and required rigidity properties which are necessary for the normal use. The sole element 7 is detachably arranged in the shoe, i.e. it is not glued or something like that.

Thus, the shoe consisting of the shoeleg or shoe upper 1 and the sole elements 2, 3 is designed so that no upper material is existent in the region of the parts of the sole. The parts of the sole 2, 3 are directly inserted into the cutouts or recesses 4, 5 and are fixed there. While the parts of the sole 2, 3 as well as the shoe upper 1 are soft and flexible, the stability of the shoe is obtained by the insole 7.

Thereby, the parts of the sole 2, 3 can have functional parts and embodiments respectively, e.g. ventilation slots or damping elements. Also, specific abrasion zones are possible.

While the shoe can be supplied with a lining in its interior to prevent locations of friction, it is preferred that the regions of the parts of the sole 2, 3 are not covered with lining.

The sole element 7 depicted in FIG. 4 is provided partially with a circumferential edge, by which the stiffness against bending can be increased.

A specific embodiment of the sole element 7 is shown in the FIGS. 5*a*, 5*b* and 6.

The sole element 7 has a hinge or articulation 8 being located approximately in the half height of its longitudinal extension. Here, this is an insection 9 running transversally to the longitudinal axis of the shoe, which is arranged at the upper side of the sole. Through this the material of the sole is weakened in the region of the hinge 8 in such a manner, that the sole element can be folded up along the incision 9; the incision 9 thus forms a bending groove. The front section 10 and the rear section 11 of the sole element 7 according to FIG. 5*a* would there be moved downwards around the location of the hinge 8 respectively.

However, the depicted insection 9 in FIG. 6, which is shown exaggerated broad there, can be so designed that a flapping of the front and rear section 10, 11 around the location of the hinge 8 upward is prevented due to the blocking effect. By this, the sole would not differ in its behavior from one-piece sole elements during its intended use.

The hinge 8 between the front and the rear section 10, 11 of the sole element 7 can also be formed during the injection molding of the element 7 by a film articulation.

In both of the mentioned embodiments a distracting rising does not come into being neither at the upper side nor at the bottom side of the sole element 7.

During use the front section 10 and the rear section 11 are held in a defined alignment to another. Then, at least two rigid regions are obtained after the insertion of the sole element 7 into the shoe.

The solution according to FIGS. 5*a*, 5*b* and 6 are characterized also in the following design: The insole has two panel-like parts 12 and 13 which consist of relatively stiff composite material, as the case may be with reinforcement with glass fibers or carbon fibers.

These are injection mold coated by another softer plastic material from which the basis part of the sole 14 is made. The basis part of the sole 14 can thereby laterally encompass or surround the panel-like parts 12 and 13.

The proposed embodiment of a shoe offers the possibility—after removal of the sole element—to quasi coil up the shoe and to store it in a small space, e.g. in a suitcase. Before use the sole element is inserted into the unrolled shoe to stiffen it and to make it thus ready to use.

LIST OF DESIGNATIONS

1 Shoe upper
2, 3 Sole
2 Part of the Sole
3 Part of the sole
4 Cutout
5 Cutout
6 Web
7 Sole element (insole)
8 Hinge/articulation
9 Insection
10 Front section
11 Rear section

12 Panel-like part
13 Panel-like part
14 Basis part of the sole

The invention claimed is:

1. A sports shoe, comprising;

a shoe upper, a sole having at least two parts, at least one part of the sole is arranged in the forefoot region and at least another part of the sole is arranged in the rearfoot region, wherein the shoe upper has at least two cutouts in the region facing the ground, the size and the shape of the cutouts correspond to those of the parts of the sole in their contact region with the shoe upper, the parts of the sole are inserted into or are placed at the cutouts and are connected with the shoe upper permanently, at least one of the parts of the sole is designed as a shell-shaped formation, the shoe upper as well as the parts of the sole consist of a material with a low bending stiffness, a removable sole element which is adapted to the shape of the foot and which has a high bending stiffness is arranged in the interior of the shoe above the parts of the sole, the bending stiffness of the sole element around an axis being arranged horizontally and transversally to the longitudinal direction of the shoe is at least five times as high as the bending stiffness of the shoe upper and the parts of the sole around the axis, the sole element extends from the toe region to the heel region continuously, the sole element has at least partially an enhanced edge, and the sole element has a soft, plastic sole portion which extends from the toe region to the heel region continuously and encompasses a stiff, forefoot part and a stiff, rearfoot part, the rearfoot part, the forefoot part separate from each other, and a transverse hinge in the sole part between the forefoot part and rearfoot part.

2. Shoe according to claim 1, wherein the shoe upper is designed continuously between the parts of the sole.

3. Shoe according to claim 2, wherein the shoe upper is designed seamless between the parts of the sole.

4. Shoe according to claim 1, wherein at least one of the parts of the sole has a web, which overlaps with the shoe upper.

5. Shoe according to claim 4, wherein the web is designed circumferentially along the connection region of the parts of the sole with the shoe upper.

6. Shoe according to claim 1, wherein the shoe upper is equipped with a lining in its interior at least partially.

7. Shoe according to claim 6, wherein the lining does not extend into the region of the parts of the sole.

8. Shoe according to claim 1, wherein the shoe upper consists of leather, artificial leather and/or textile material.

9. Shoe according to claim 1, wherein the parts of the sole consists of rubber, polyurethane, polyamide, thermoplastic caoutchouc, ethyl vinyl acetate (EVA) or a mixture of these materials.

10. Shoe according to claim 1, wherein the hinge is directly injection molded to the both parts.

11. Shoe according to claim 10, wherein the hinge consists of polyurethane, polyamide, polyethylene, polypropylene or a mixture of these materials.

12. Shoe according to claim 1, wherein the sole element is provided with reinforcing fibers.

13. Shoe according to claim 12, wherein the reinforcing fibers are glass fibers or carbon fibers.

14. Shoe according to claim 1, wherein the shoe upper and the parts of the sole are sewn together.

15. Shoe according to claim 1, wherein the shoe upper and the parts of the sole are glued together.

16. Shoe according to claim 1, wherein the shoe upper and the parts of the sole are welded together.

17. Shoe according to claim 1, wherein at least one of the parts of the sole is provided with ventilation slots.

18. Shoe according to claim 1, wherein at least one of the parts of the sole is provided with a damping element.

* * * * *

UNITED STATES PATENT AND TRADEMARK OFFICE

CERTIFICATE OF CORRECTION

PATENT NO. : 8,240,067 B2
APPLICATION NO. : 12/160256
DATED : August 14, 2012
INVENTOR(S) : Reinhold Sussmann It is certified that error appears in the above-identified patent and that said Letters Patent is hereby corrected as shown below:

Title Page

Item 73, the Assignee is,

PUMA SE
Herzogenaurach (DE)

Signed and Sealed this
Twenty-third Day of April, 2013

Teresa Stanek Rea
*Acting Director of the United States Patent and Trademark Office*